US006047507A

United States Patent [19]

Lappin et al.

[11] Patent Number: 6,047,507

[45] Date of Patent: Apr. 11, 2000

[54] LINEAL CORNER BLOCK

[75] Inventors: Rick Lappin, San Bernardino, Calif.; Robert Long, Westchester, Pa.

[73] Assignee: CertainTeed Corporation, Valley Forge, Pa.

[21] Appl. No.: 09/100,552

[22] Filed: Jun. 19, 1998

[51] Int. Cl.[7] ..... E06B 1/04; E06B 1/26

[52] U.S. Cl. ..... 52/212; 52/311.1; 52/302.1; 52/656.2; 52/656.4; 52/656.5; 52/656.9; 52/657; 52/717.01; 52/745.16

[58] Field of Search ..... 52/212, 311.1, 52/656.2, 656.4, 656.5, 656.9, 657, 717.01, 745.16, 302.1

[56] References Cited

U.S. PATENT DOCUMENTS

| | | | |
|---|---|---|---|
| 4,250,677 | 2/1981 | Yablonski . | |
| 4,608,800 | 9/1986 | Fredette . | |
| 5,003,738 | 4/1991 | Hogeland . | |
| 5,038,592 | 8/1991 | Knudson . | |
| 5,586,415 | 12/1996 | Fisher et al. . | |
| 5,625,992 | 5/1997 | Strick et al. | 52/212 X |
| 5,875,602 | 3/1999 | Lappin et al. | 52/717.01 X |
| 5,924,259 | 7/1999 | Marousek | 52/717.01 X |

OTHER PUBLICATIONS

Ribco, Inc., "E–Z Corners" 2 page ad.

*Primary Examiner*—Christopher T. Kent
*Attorney, Agent, or Firm*—Duane Morris & Heckscher LLP; Peter J. Cronk; Steven E. Koffs

[57] ABSTRACT

A frame for a door or window includes a plurality of frame portions, which may be lineals, and a plurality of corner blocks. For a door frame, three frame portions and two corner blocks are used. For a window frame, four frame portions and four corner portions are used. Each corner block comprises first and second mounting flange portions for attaching the corner block to a surface, such as an exterior wall of a building. First and second channel portions are each attached to a respective mounting flange portion. Each of the first and second channel portions is shaped to engage a respective one of a first and a second frame portions. A cover portion is attached to both of the first and second channel portions. The cover portion has first and second overlap portions which overlap the first and second frame portions, respectively, when the first and second channel portions engage the first and second frame portions. An ornamental "rosette" may be attached to the cover portion of the corner block.

25 Claims, 8 Drawing Sheets

LINEAL CORNER BLOCK

FIELD OF THE INVENTION

The present invention relates to building materials generally, and more specifically to materials for framing a door or window.

DESCRIPTION OF THE RELATED ART

Siding of aluminum or vinyl is widely used for building exteriors, due to its attractive appearance, durability and low maintenance costs.

To provide a more professional, finished appearance, openings in a building exterior are often framed by wide faced "lineals", such as the CertainTeed™ brand 3L3 lineal member. Such lineals are typically 8.9 centimeters (3.5 inches) or 12.7 centimeters (5 inches) wide. An exemplary lineal member includes a mounting flange portion running along its length, and having a plurality of openings. The mounting flange portion is fastened to the building surface, beneath the ends of the siding. A concave channel portion is attached to the mounting flange portion, running lengthwise along the lineal. The channel portion receives the ends of the strips of siding. The lineal has a cover portion attached to the channel portion. The cover portion overlaps the ends of the siding strips, concealing any variation in the length of the siding strips, which may be present after the strips are cut by the installer. The cover portion of the lineal provides the visible frame around the door or window.

In the prior art, one of the most difficult aspects of forming a frame around a door or window is the step of forming corners between vertical and horizontal lineals. If the ends of the lineals are cut at a 45 degree bevel angle, the process is time consuming, and a small error in cutting the part may result in an objectionable gap. Some installers have attempted to reduce installation time by butting the horizontal and vertical lineals together, resulting in an objectionable appearance.

A frame configuration is desired that can be installed rapidly and easily, but still provides a uniform and aesthetically pleasing appearance.

SUMMARY OF THE INVENTION

The present invention is a corner block, a frame which includes the corner block, and a method for forming a frame assembly using the corner block. The corner block comprises first and second mounting flange portions for attaching the corner block to a surface. First and second channel portions are each attached to a respective mounting flange portion. Each of the first and second channel portions is shaped to engage a respective one of a first and a second frame portions. A cover portion is attached to both of the first and second channel portions. The cover portion has first and second overlap portions which overlap the first and second frame portions, respectively, when the first and second channel portions engage the first and second frame portions.

DETAILED DESCRIPTION

Figure 1A:
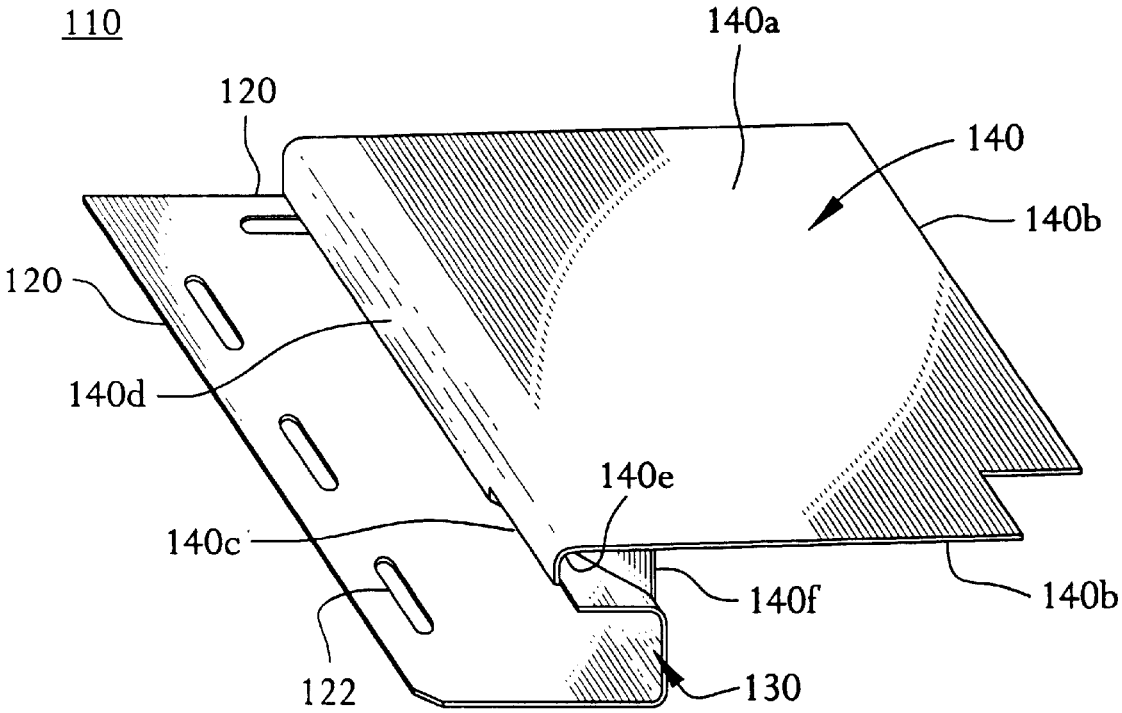
FIG. 1A is an isometric view of an exemplary corner block according to the present invention.
Figure 1B:
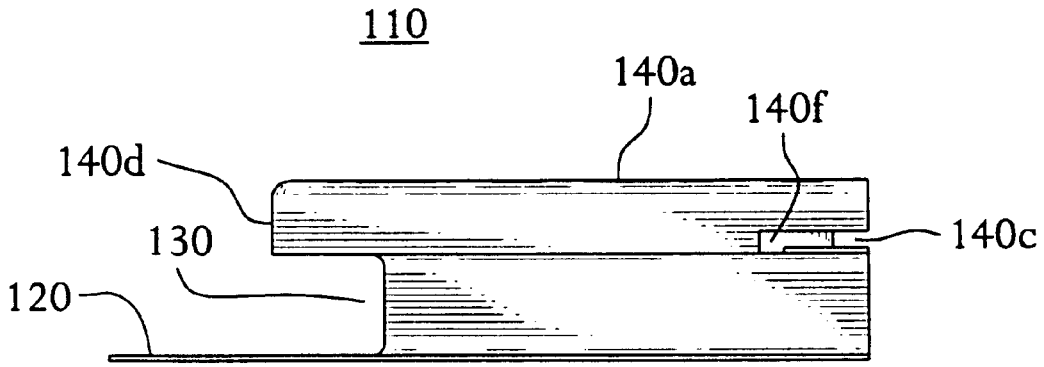
FIG. 1B is an elevation view of the left edge of the corner block shown in FIG. 1A.
Figure 1C:
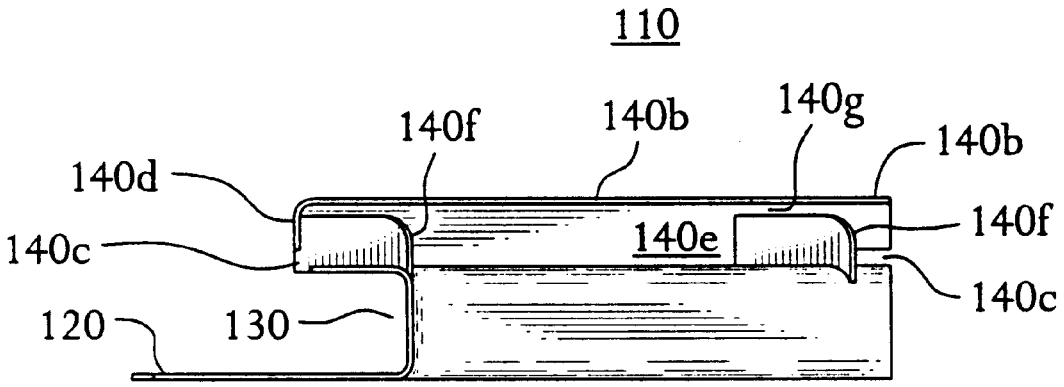
FIG. 1C is an elevation view of the bottom edge of the corner block shown in FIG. 1A.

FIG. 1A is an isometric view of an exemplary corner block 110 according to the present invention. FIGS. 1B and 1C are elevation views of the left and bottom edges of the corner block 110. The corner block 110 is suitable for joining a pair of frame portions, which may be "lineals" 190 (shown in FIGS. 2 and 3) in a door or window frame or a frame surrounding an arch. The corner block may be installed at each corner where two perpendicular lineals 190 meet. The corner block 110 joins the lineals 190, promotes drainage, and provides a finished appearance without the need for time consuming mitering operations.

Figure 2:
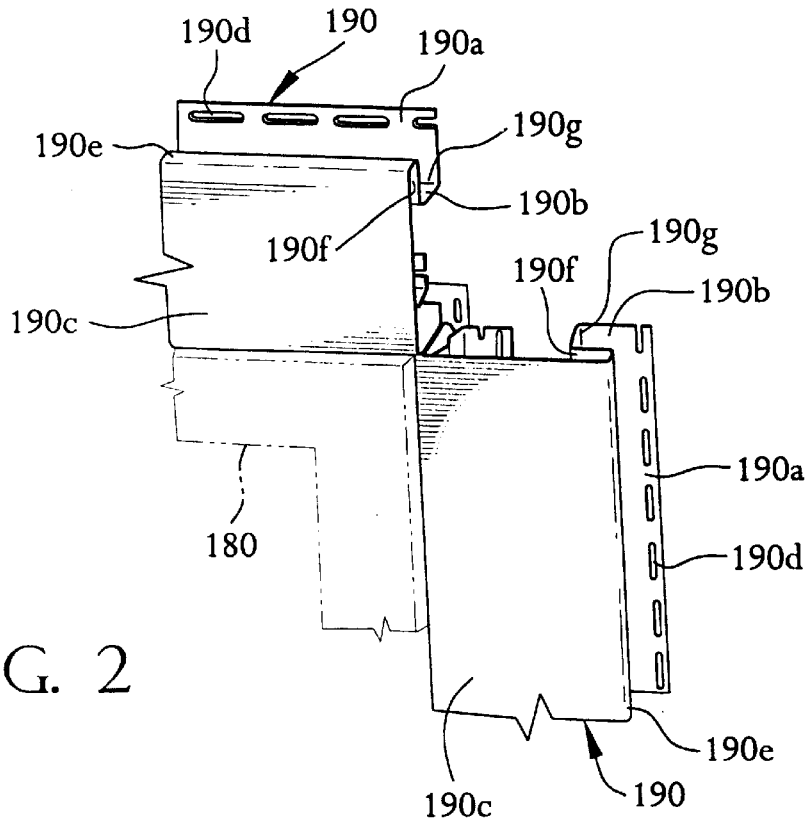
FIG. 2 is an isometric view of two lineals cut for use with a corner block according to the invention.
Figure 5:
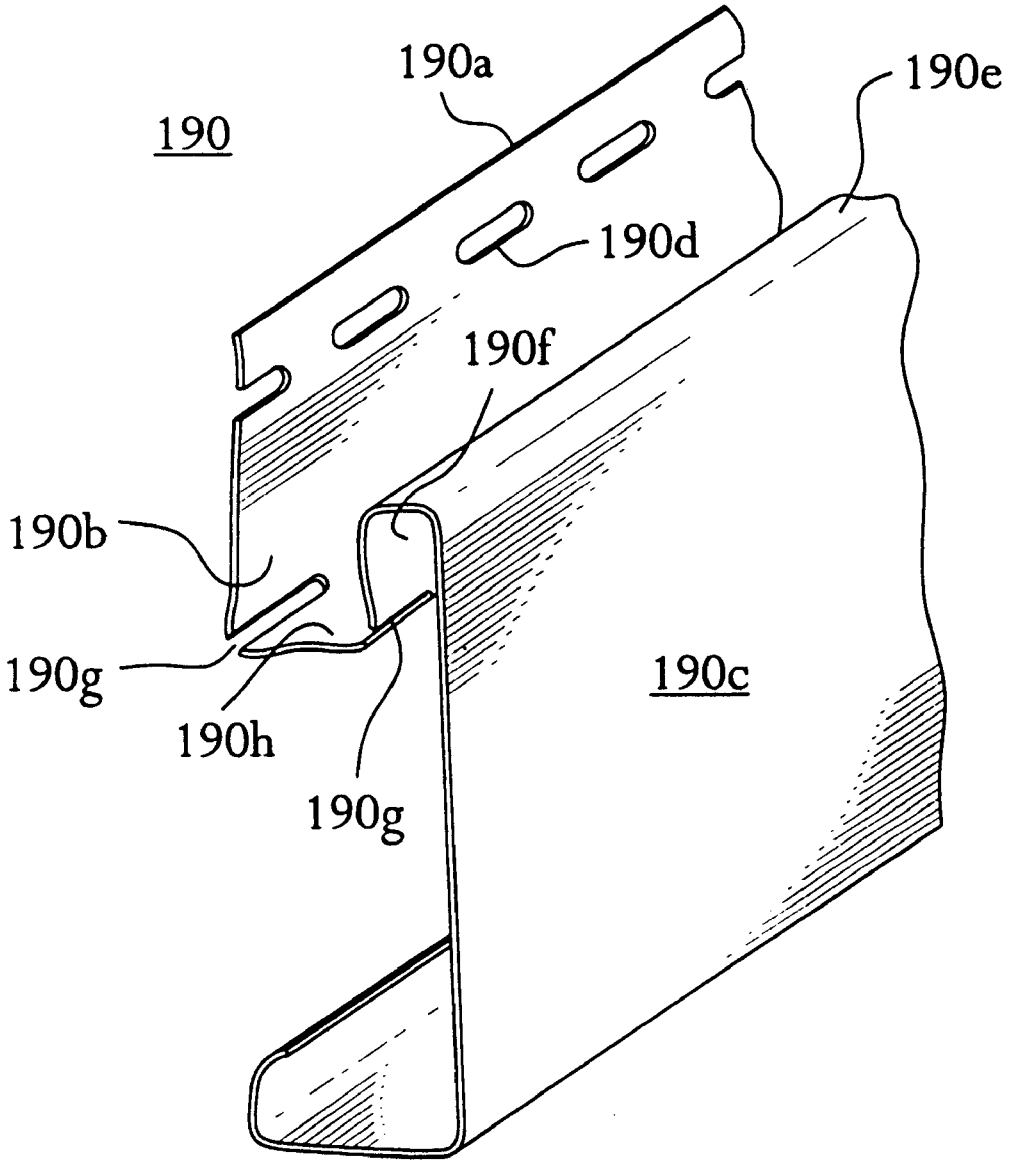
FIG. 5 is an isometric view of the lineals of FIG. 2.

The function of corner block 110 is best understood by first reviewing the structure of the lineal frame member 190 to which the corner block is attached. FIGS. 2 and 5 show the ends of two perpendicular frame members 190, which are lineals. The frame members 190 shown in FIGS. 2 and 5 are cut and positioned for installation of the corner block 110. Each frame member 190 has a front face 190*c*, an outer edge 190*e*, a channel 190*b* and a mounting flange 190*a*. A concavity 190*f* is formed behind outer edge 190*e*. The channel 190*b*, outer edge 190*e*, and front face form an "S" shaped cross section.

Referring now to FIGS. 1A–1C and 3, the configuration of the frame assembly 100 is shown. The corner block 110 has first and second mounting flange portions 120 for attaching the corner block 110 to a surface, which may be, for example, the exterior surface of a wall surrounding a window or a door (shown in phantom as 180 in FIGS. 2 and 3). The mounting flange portions 120 each have a plurality of openings 122 for receiving fasteners 185, to attach the corner block 110 to the surface. In the exemplary embodiment, the holes 122 have the same general shape and configuration as the holes 190*d* on the mounting flanges 190*a* of the lineals 190. Nevertheless, the configuration of holes 122 may be varied without substantially changing the function of the mounting flange portions 120.

Figure 3:
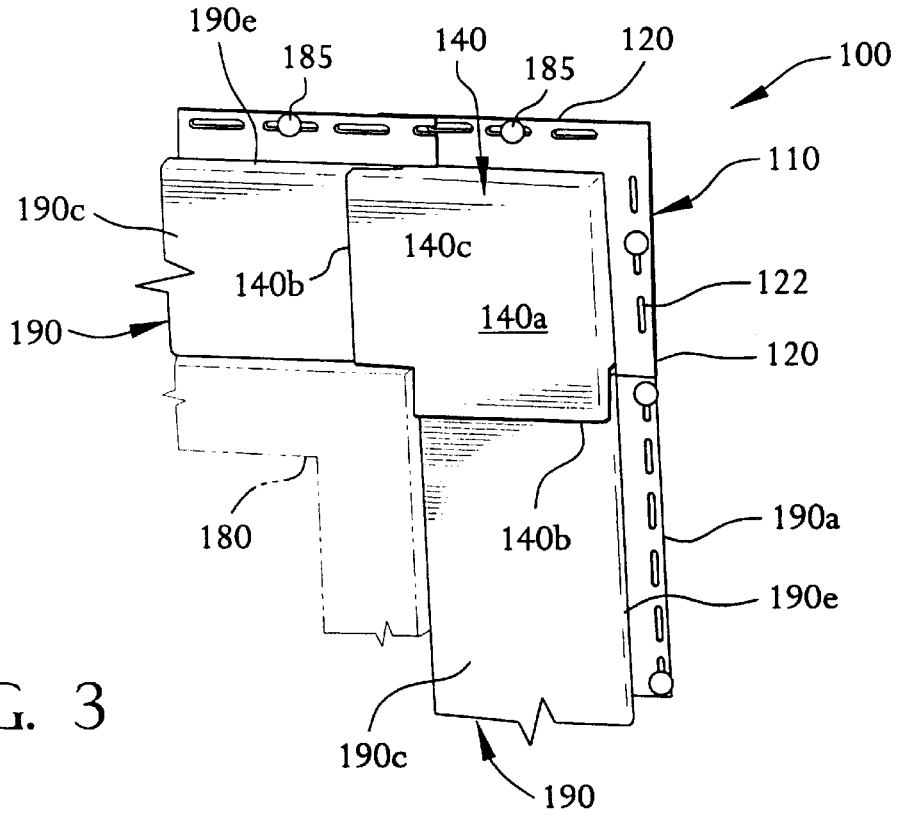
FIG. 3 is an isometric view of the corner block of FIG. 1A assembled to the lineals of FIG. 2.
Figure 4:
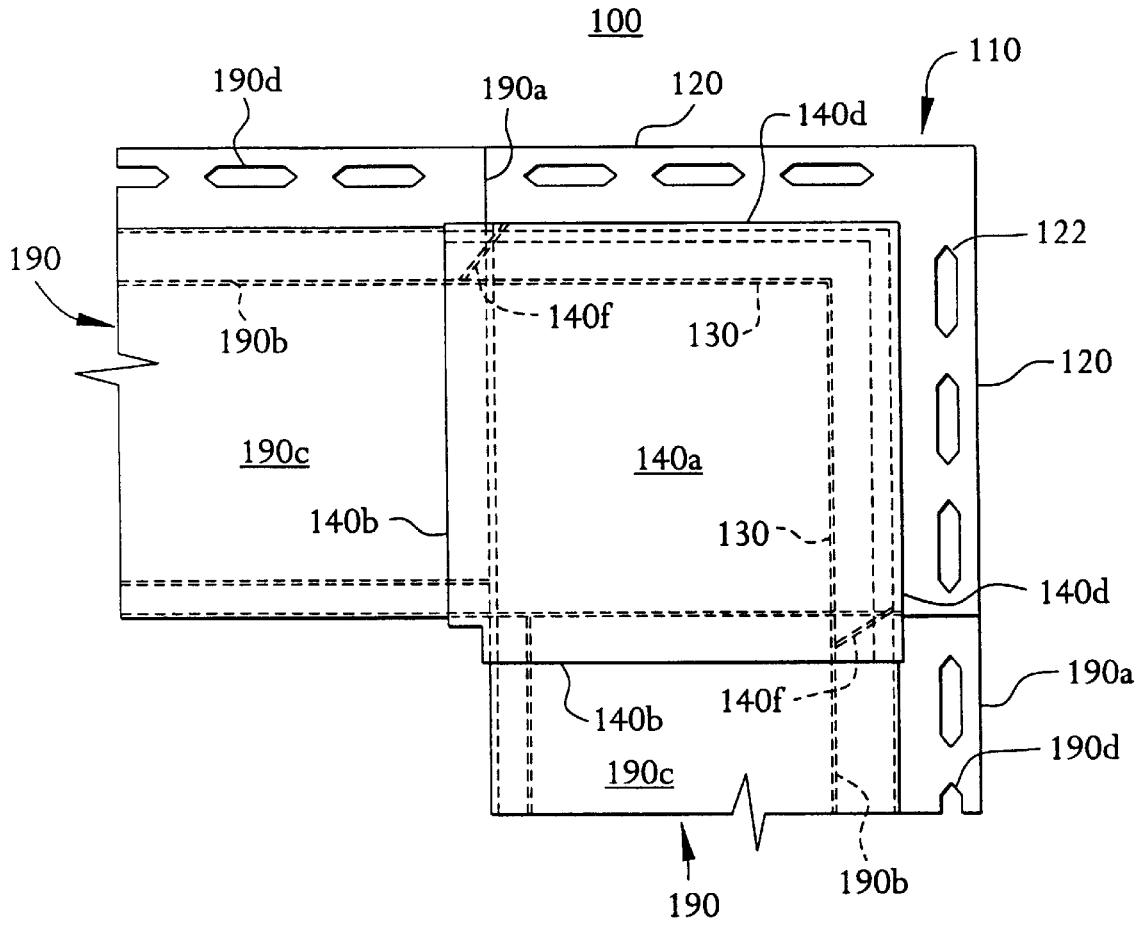
FIG. 4 is a plan view of the assembly of FIG. 3.

The mounting flange portions 120 may meet in a continuous "L" shape as best seen in FIG. 3, or in a variation of the exemplary embodiment (not shown), the mounting flange portions may be two separate rectangular portions on two adjacent sides of the corner block 110. Further, because the mounting flange portions 120 are hidden after installation, the shape of the outer edges of the mounting flange portions 120 may be varied in an ornamental fashion, without affecting the function of these parts.

First and second channel portions 130 are each integrally attached to a respective mounting flange portion 120, respectively. Each of the first and second channel portions 130 is shaped to engage the channel of a respective frame portion 190.

Preferably, the channel portions 130 of the cover block 110 and the lineals 190 are installed in a configuration which enhances drainage. For example, when connecting the top frame member 190 to its adjacent corner blocks 110, the channel portion 190*b* of frame member 190 is placed inside of the channel portion 130 of the corner block 110. On the other hand, when connecting the side frame member 190 to its adjacent corner blocks 110, the channel portion 130 of the corner block 110 is placed inside of the channel portion 190*b* of frame member 190. In both cases, the channel which is higher is inserted inside the channel which is lower, so that (precipitation) water is channeled away from the door or window 180.

A cover portion 140 is attached to both of the first and second channel portions 130. The cover portion 140 has a front face 140*a*, which includes two overlap portions 140*b*. The overlap portions 140*b* overlap and conceal the ends of the first and second frame portions 190, respectively, when the first and second channel portions 130 of corner block 110 engage the respective channel portions 190*b* of frame portions 190. The cover portion 140 also has an outer edge 140*d*, which connects the front face 140*a* of cover portion 140 to the channel portions 130. A concavity 140*e* is formed behind outer edge 140*d*, that is, between front face 140*a*, outer edge 140*d* and channel portion 130.

The cover 140 has two slots 140*c*. The slots 140*c* are located on the overlap portions 140*b* of the cover 140, between the outer edge 140*d* and the channel portion 130. A stop 140*f* in the form of a diagonal fin or web extends upwardly from the top surface of channel portion 130. Stop 140*f* meets with the end of slot 140*c*. In the exemplary embodiment, stop 140*f* is integrally attached to the top surface of channel portion 130 and the inside surface of outer edge 140*d*, but there is a clearance 140*g* (shown in FIG. 1C) between stop 140*f* and the bottom surface of front face 140*a*. The clearance 140*g* is sufficiently thick to permit the front face 190*c* of frame member 190 to fit between stop 140*f* and the front face 140*a* of corner block 110; frame member 190 is inserted until it reaches the point where outer edge 140*d* meets stop 140*f* at the end of slot 140*c*.

One of ordinary skill recognizes that the slot 140*c* allows the channel portion 190*b* of the S-shaped lineal 190 to fit inside the channel portion 130 of corner block 110, while the concavity 140*e* of corner block 110 receives the outer edge portion 190*e* of lineal 190. In other words, the two S-shaped cross-sections intersect one another at or near the inflection point of the "S," so that both portions (channel 190*b* and concavity 190*f* of outer edge 190*e*) of lineal 190 can fit inside the corresponding concave portions of corner block 110 simultaneously.

Insertion of the frame members 190 into the corner block may be facilitated by cutting two slits 190*g* about 2.0 to 2.5 centimeters long at the end of the channel portion 190*b* of frame member 190, as best seen in FIG. 5. These cuts may be performed, for example, using conventional vinyl snips for a vinyl lineal 190. Once the slits 190*g* are formed, the bottom of channel portion 190*b* has a flexible strip 190*h* at its end. The strips 190*h* of any top (horizontal) frame members 190 are placed inside the channel 130 of the corresponding corner block 110. The strips 190*h* of any side (vertical) frame members 190 are placed beneath the channel 130 of corner block 110. Further, the mounting flanges 190*a* of top (horizontal) frame members 190 are mounted over the mounting flanges 120*a* of corner block 110, but the mounting flanges 190*a* of side (vertical) frame members 190 are mounted under the mounting flanges 120*a* of the corner block 110. These techniques further promote proper drainage. Further, use of these technique allows a single corner block design to be used for all four corners of a window; it is not necessary to provide unique left-handed, right-handed, top and bottom corner blocks.

A corner block as described herein may be formed from a single piece of a polymer such as a vinyl material. Other materials, such as polypropylene, other polymers, or a polymer composite (such as polymer with reinforcing fibers of glass, graphite, wood, flax or other organic material), or metal, such as aluminum, or polymer coated metal, may also be used.

A corner block as described above may also include an ornamental "rosette." The cover portion 140 may include means for fastening an ornament to the corner block. For example, the front face 140*a* of the cover portion 140 may include a hole, which may be used to mount a rosette using any conventional fastener. In the exemplary embodiment, the rear surface of the front face 140*a* has a dimple 240*g* (shown in FIG. 6) at its center. The dimple may be drilled or punched through to form a hole, and a decorative rosette applied using a screw, pin and clip, or other fastener. If no rosette is to be used, the dimple is not punched through.

Figure 6:
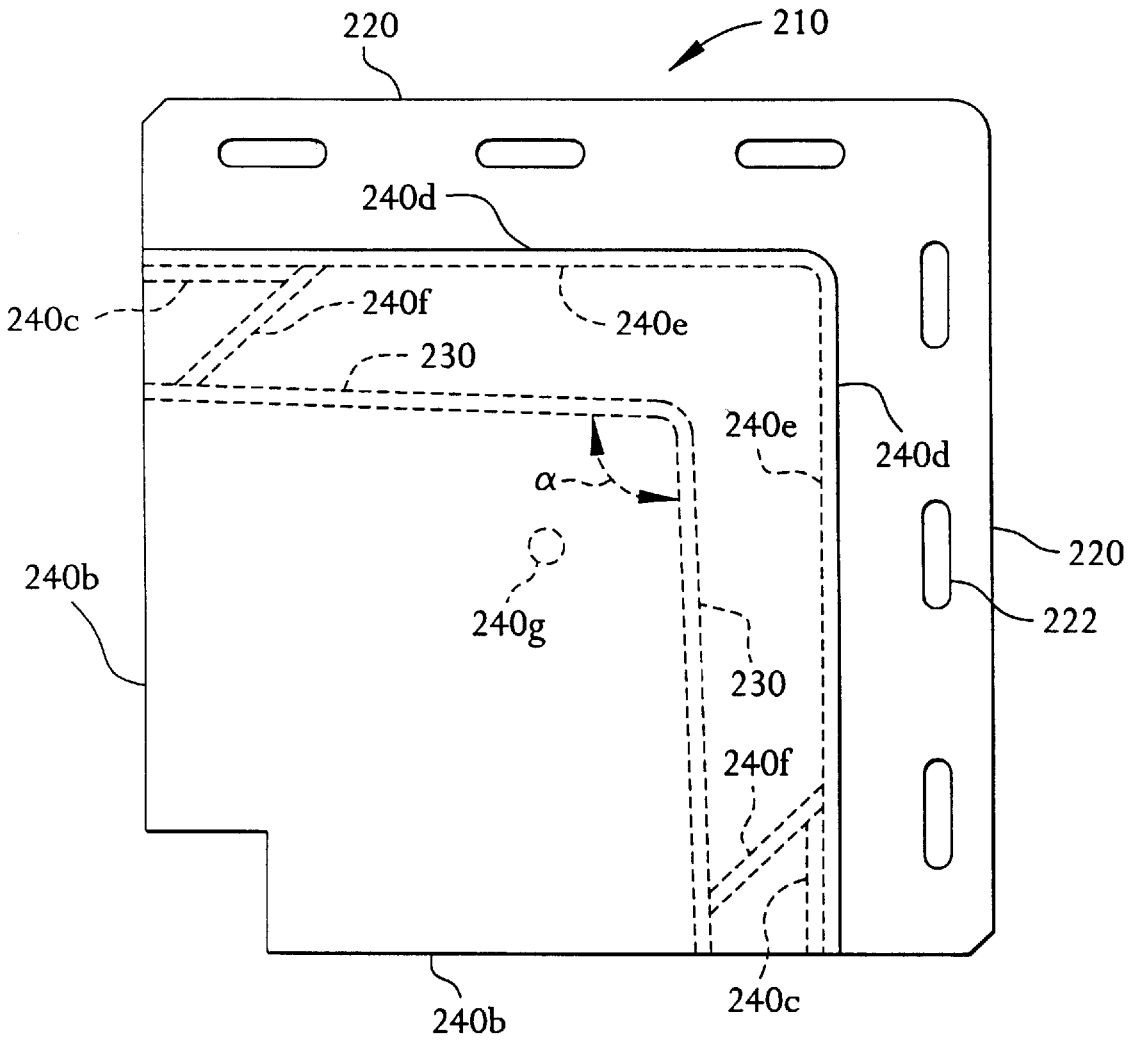
FIG. 6 is a plan view of a variation of the exemplary corner block according to the invention.

FIG. 6 shows a variation of the exemplary embodiment of the invention. In corner block 210, the first and second channel portions 230 meet at an angle $\alpha$ that is greater than 90 degrees. As a result, channel portions 230 are inclined relative to the first and second frame portions 190, respectively. This may further enhance drainage of water away from the window or door.

Figure 7:
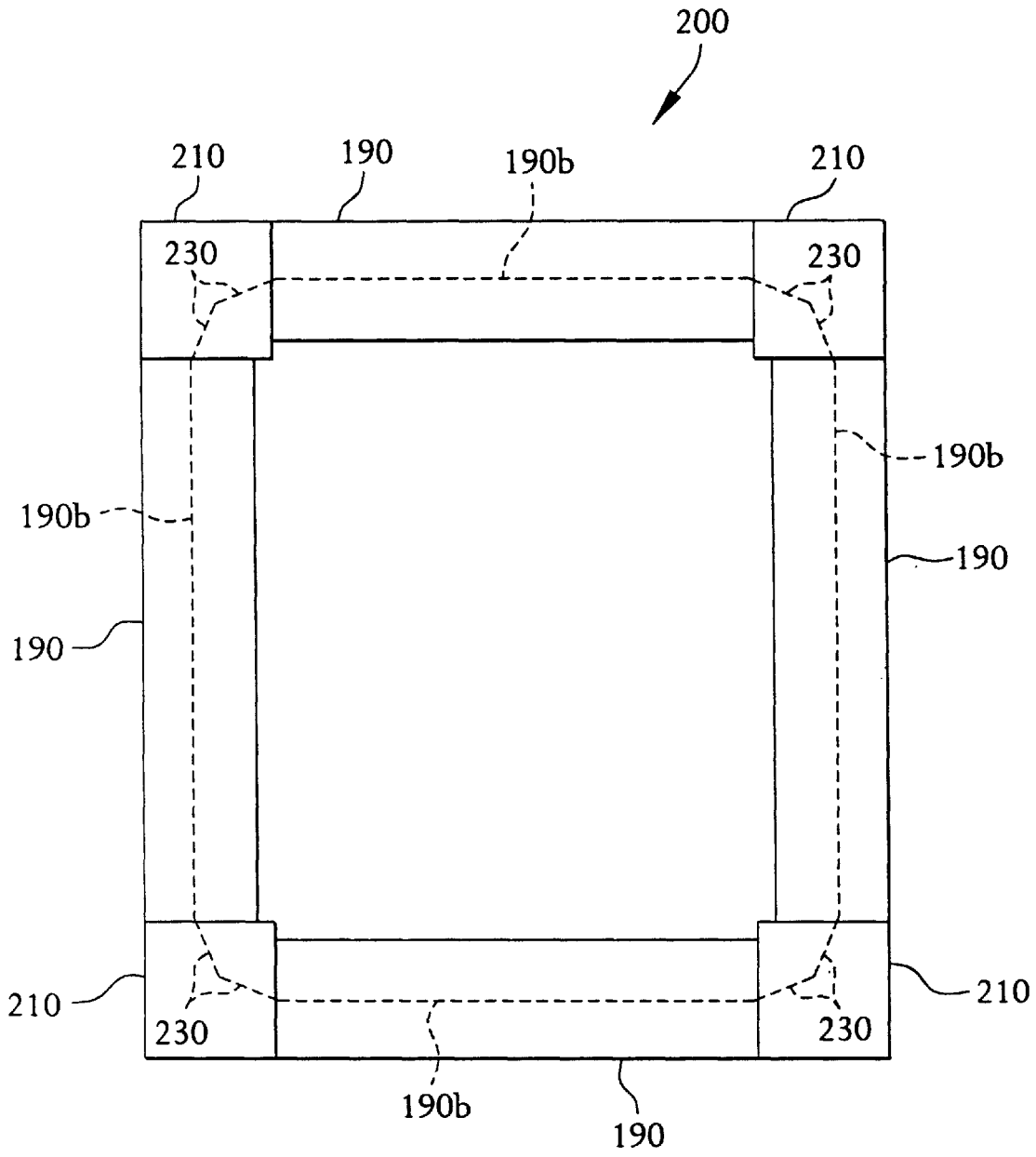
FIG. 7 is a plan view showing the configuration of a frame assembly including four lineals and four of the corner blocks shown in FIG. 6.
Figure 8:
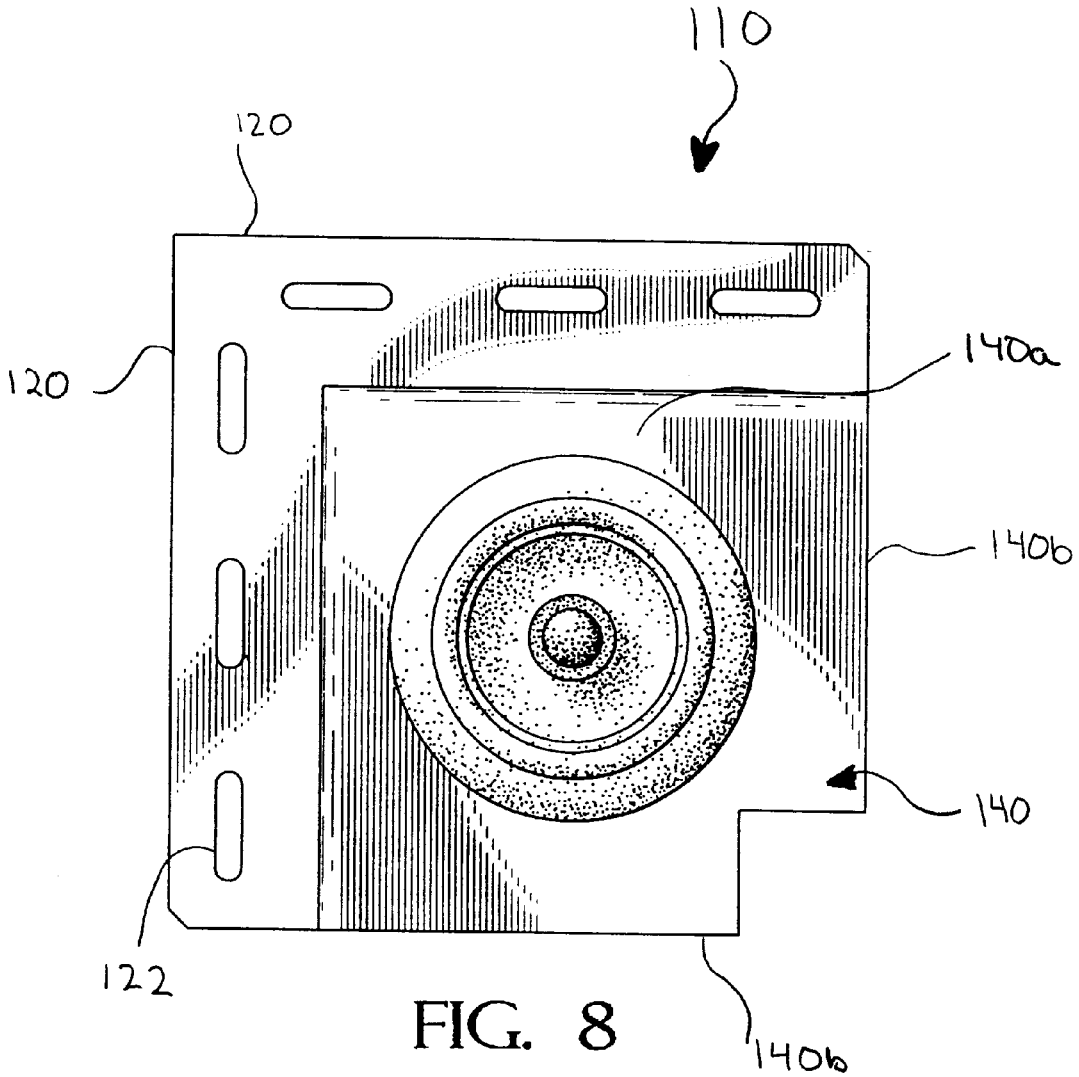
FIG. 8 is a plan view of a corner block with a rosette ornamentation.

FIG. 7 shows a rectangular frame 200 formed from four lineals 190 and four of the corner blocks 210 of the type shown in FIG. 6. The channel portions 190*b* of the frame members 190 and the channel portions 230 of corner blocks 210 are shown in phantom. The channel portions 190*b* and 230 together form a twelve-sided polygon. One of ordinary skill in the art recognizes that FIG. 7 is not drawn to scale; features are omitted for simplicity, and the features which are shown have been exaggerated for illustrative purposes.

In this variation the first and second channel portions 230 are inclined so that, if one of the first or second channel portions 230 is facing substantially upward, the inclination of that one upward facing channel portion diverts a fluid away from the frame portion 190 to which that one upward facing channel portion 230 is attached. For example, if rain falls into the channel 190*b* of the top frame member 190, channel portion 230 of corner block 210 slopes downward away from the window or door 180.

One of ordinary skill in the art recognizes that conventional steps of cutting the siding strips to length, installing the siding, and applying caulk are well understood and are not described herein.

Although the exemplary corner block is described for a forming a 90 degree angle in a frame, one of ordinary skill recognizes that non-rectangular frames may be formed using a corner block in accordance with the present invention. For example, instead of providing a 90 degree bend at each corner, a corner block (not shown) may include 45 degree bends at each corner. These 45 degree corner bends may be used for an octagonal window, or for a five-sided (inverted "U" shaped) arch surrounding a doorway. Other bend angles, besides 90 degrees or 45 degrees, may also be used.

Further, although the exemplary corner block joins two lineals which intersect at a corner of a rectangular window, the corner block may be constructed to join two lineals which are separated by a distance. For example, the corner block may incorporate one or two lengths of frame members between the overlap portions. Still further, the corner block may incorporate a curved section of a frame member for a window having curved corners.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A corner block, comprising:

first and second mounting flange portions for attaching the corner block to a surface;

first and second channel portions, each attached to a respective mounting flange portion, each of the first and second channel portions being shaped to engage a respective one of a first and a second frame portions; and a cover portion attached to both of the first and second channel portions, the cover portion having first and second overlap portions which overlap the first and second frame portions, respectively, when the first and second channel portions engage the first and second frame portions, wherein the first and second channel portions are inclined relative to a first outer edge and a second outer edge, respectively, of the cover portion.

2. A corner block according to claim 1, wherein the first and second channel portions are inclined so that, if one of the first or second channel portions is facing substantially upward, the inclination of that one upward facing channel portion diverts a fluid away from the frame portion to which that one upward facing channel portion is attached.

3. A corner block according to claim 1, wherein the first and second channel portions meet at an angle that is greater than 90 degrees.

4. A corner block according to claim 1, said corner block being formed from a single piece of a vinyl material.

5. A corner block according to claim 1, wherein:

the first and second mounting flange portions form an L-shaped mounting flange;

the first and second channel portions are inclined and meet each other at an angle greater than 90 degrees, so that, if one of the first or second channel portions is facing substantially upward, the inclination of that one upward facing channel portion diverts a fluid away from the frame portion to which that one upward facing channel portion is attached;

the first and second channel portions engage the first and second frame portions, so that the ends of the first and second frame portions are hidden; and the cover portion includes means for fastening an ornament to the corner block.

6. A corner block according to claim 1, wherein an interior U-shaped concavity is formed between the cover portion and each channel portion, the concavity shaped to receive an edge of one of the frame portions.

7. A corner block according to claim 6, further comprising an edge between the cover and each channel portion, wherein the cover, one of the edges and the channel portion adjacent to the one edge form an "S" shape.

8. A corner block, comprising:

first and second mounting flange portions for attaching the corner block to a surface;

first and second channel portions, each attached to a respective mounting flange portion, each of the first and second channel portions being shaped to engage a respective one of a first and a second frame portions; and a cover portion attached to both of the first and second channel portions, the cover portion having first and second overlap portions which overlap the first and second frame portions, respectively, when the first and second channel portions engage the first and second frame portions, said cover portion including means for fastening an ornament to the corner block.

9. A frame assembly comprising:

at least three frame portions and at least two corner blocks alternately arranged to form a frame, wherein each of the corner blocks comprises:

(a) first and second mounting flange portions for attaching the corner block to a surface;

(b) first and second channel portions, each attached to a respective mounting flange portion, each of the first and second channel portions being shaped to engage a respective one of a first and a second one of the frame portions, the first and second channel portions being inclined relative to the first and second ones of the frame portions; and (c) a cover portion attached to both of the first and second channel portions, the cover portion having first and second overlap portions which overlap the first and second ones of the frame portions, respectively.

10. A frame assembly according to claim 9, wherein one of the frame members is a top frame member, and a top one of the channel portions of each corner block is inclined downward from the top frame member, so that the inclination of each of the top channel portions diverts a fluid away from the top frame portion.

11. A frame assembly according to claim 10, wherein at least two of the frame members are side-facing members, and a side-facing channel portion of each corner block is received within a channel portion of a respective one of the side-facing members, so that the fluid is diverted outward beyond a top end of each of the side-facing members.

12. A frame assembly according to claim 8, wherein the assembly includes four frame portions and four corner blocks alternately arranged to form a rectangular frame.

13. A frame assembly according to claim 12, wherein:

each of the frame members has a channel, and the channels of the frame portions and channel portions of the corner blocks are connected to each other to form a twelve-sided polygon.

14. A frame assembly according to claim 8, wherein the first and second channel portions meet at an angle that is greater than 90 degrees.

15. A frame assembly according to claim 8, said corner block being formed from a single piece of a vinyl material.

16. A frame assembly according to claim 8, wherein the cover portion includes means for fastening an ornament to the corner block.

17. A frame assembly according to claim 8, wherein each frame portion has a channel portion, and the channel portion of each frame portion is sized to be received by the channel portion of any one of the corner blocks.

18. A frame assembly according to claim 8, wherein:

the assembly includes four frame portions and four corner blocks alternately arranged to form a rectangular frame;

each of the frame members has a channel, and the channels of the frame portions and channel portions of the corner blocks are connected to each other to form a rectangle.

19. A corner block, comprising:

a mounting flange having first and second mounting flange portions for attaching the corner block to a surface;

first and second U-shaped channel portions, each attached to a respective mounting flange portion, each of the first and second channel portions being shaped to engage a respective one of a first and a second frame portions;

a cover portion attached to both of the first and second channel portions, the cover portion having first and second overlap portions which overlap the first and second frame portions, respectively, when the first and second channel portions engage the first and second frame portions, so that the ends of the first and second frame portions are hidden; and first and second slots between the cover and the first and second channel portions, respectively, wherein an interior U-shaped concavity is formed between the cover portion and each channel portion, the concavity shaped to receive an edge of one of the frame portions.

20. A corner block according to claim 19, further comprising an edge between the cover and each channel portion, wherein the cover, one of the edges and the channel portion adjacent to the one edge form an "S" shape.

21. A method for forming a frame assembly, comprising the steps of:

(a) providing at least three frame portions, each frame portion having a channel portion, (b) providing at least two corner blocks, each corner block having first and second channel portions, a cover, and first and second slots between the cover and the first and second channel portions, respectively;

(c) alternately arranging the frame portions and corner blocks around an opening in a wall, to form a frame;

(d) inserting an end of the channel portion of each frame portion into one of the first and second channel portions of the corner block nearest to that frame portion, with an end of each frame member inside a slot of the corner block nearest to that frame portion.

22. A method according to claim 21, further comprising the step of:

(e) inserting fasteners into the mounting flanges of the frame portions and the mounting flange portions of the corner blocks to secure the frame members and corner blocks to the wall.

23. A method according to claim 21, wherein each cover block includes a cover portion having first and second overlap portions, and step (d) includes concealing ends of the frame members behind the overlap portions.

24. A method according to claim 21, further comprising, before step (c), the step of fastening a rosette onto a cover portion of each of the corner blocks.

25. A method according to claim 21, further comprising the steps of:

cutting slits in the channel portions of one of the frame members, to form a strip at a bottom of the channel portion;

inserting the strip inside one of the channel portions of the corner block if the one frame member is a top frame member; and inserting the strip behind one of the channel portions of the corner block if the one frame member is a side frame member.

* * * * *